US007009575B2

(12) United States Patent
Holly et al.

(10) Patent No.: US 7,009,575 B2
(45) **Date of Patent: *Mar. 7, 2006**

(54) HIGH-FREQUENCY TWO-DIMENSIONAL ANTENNA AND ASSOCIATED DOWN-CONVERSION METHOD

(75) Inventors: Sandor Holly, Woodland Hills, CA (US); Nicholas Koumvakalis, Thousand Oaks, CA (US)

(73) Assignee: The Boeing Company, Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/780,536

(22) Filed: Feb. 16, 2004

(65) Prior Publication Data

US 2005/0179612 A1 Aug. 18, 2005

(51) Int. Cl.
*H01Q 9/16* (2006.01)

(52) U.S. Cl. ..... 343/820; 343/793; 343/814

(58) Field of Classification Search ..... 343/793, 343/801, 802, 814, 816, 820, 822, 853
See application file for complete search history.

(56) References Cited

U.S. PATENT DOCUMENTS

| | | | | |
|---|---|---|---|---|
| 3,348,093 | A | 10/1967 | Holly | |
| 4,479,130 | A * | 10/1984 | Snyder | 343/802 |
| 4,733,244 | A * | 3/1988 | Edenhofer et al. | 343/756 |
| 5,148,182 | A * | 9/1992 | Gautier et al. | 343/754 |
| 5,214,436 | A * | 5/1993 | Hannan | 343/705 |
| 5,420,595 | A | 5/1995 | Zhang et al. | |
| 5,856,803 | A | 1/1999 | Pevler | |
| 6,864,825 | B1 * | 3/2005 | Holly | 342/13 |

OTHER PUBLICATIONS

Peter H. Siegel, *Terahertz Technology, IEEE Transactions on Microwave Theory and Techniques,* Mar. 2002, pp. 910-928, vol. 50.

Peter H. Siegel, *THz Technology: An Overview, International Journal of High Speed Electronics and Systems,* 2003, pp. 1-44, vol. 13—No. 2, World Scientific Publishing Company, USA.

Sanjay Raman, N. Scott Barker, and Gabriel M. Rebeiz; *A W-Band Dielectric-Lens-Based Integrated Monopulse Radar Receiver,* IEEE Transactions on Microwave Theory and Techniques; Dec. 1998; pp. 2308-2316; vol. 46, No. 12.

Daniel F. Filipovic, Gildas P. Gauthier, Sanjay Raman, and Gabriel M. Rebeiz; *Off-Axis Properties of Silicon and Quartz Dielectric Lens Antennas,* IEEE Transactions on Antennas and Propagation; May 1997; pp. 760-766; vol. 45, No. 5.

* cited by examiner

*Primary Examiner*—Tho Phan
(74) *Attorney, Agent, or Firm*—Alston & Bird LLP

(57) ABSTRACT

A high-frequency two-dimensional antenna includes a plurality of dual-frequency antennas configured to receive signals having first and second frequencies above the microwave band of the electromagnetic spectrum. The dual-frequency antennas of the two-dimensional antenna are arrayed to an effective length to re-radiate signals at a third frequency, which is down-converted from the first and second frequencies. Each dual-frequency antenna of the two-dimensional antenna includes a plurality of dipole antennas, and a plurality of nonlinear resonant circuits. The nonlinear resonant circuits interconnect the dipole antennas and are configured to permit re-radiation of signals having the third frequency over the effective length. A method of down-converting signals having at least first and second electromagnetic radiation frequencies is also provided.

22 Claims, 6 Drawing Sheets

HIGH-FREQUENCY TWO-DIMENSIONAL ANTENNA AND ASSOCIATED DOWN-CONVERSION METHOD

FIELD OF THE INVENTION

The present invention relates to a millimeter and submillimeter wave and optical antennas, and more particularly, to a high-frequency two-dimensional antenna and associated method for converting electromagnetic radiation from a first and second frequency to a third, a difference frequency and reradiating the resulting difference frequency.

BACKGROUND OF THE INVENTION

As described in co-pending U.S. patent application Ser. No. 10/444,510 incorporated herein by reference, FIG. 1 illustrates two sources of electromagnetic radiation collimated millimeter wave sources 10, 20 radiating collimated beams 12, 22 of electromagnetic radiation at two separate frequencies, $f_1$ and $f_2$, and in two intersecting directions that produce interference at a distance. Generally, when two electromagnetic beams of different frequencies converge, the volume of the intersection 24 will include a frequency component which is equal to the difference in frequency of the two beams, which is defined herein as the interference difference frequency, $\Delta f$. More specifically, the electromagnetic interference at the interference difference frequency, $\Delta f$, is optimal in that the electromagnetic interference field strength is at a maximum when the beams are diffraction limited and collimated having substantially equal intensities and either linearly or circularly polarized. When the interference difference frequency is incident upon electronic components at or near the interference frequency, the resultant field will interfere with the operation of the electronics.

The interference difference frequency, $\Delta f$, is generated by intermodulation, which is defined as the production in an electrical device of currents having frequencies equal to the sums and differences of frequencies supplied to the device. In this regard, intermodulation occurs through nonlinear surface and volume effects (such as oxide layers, corroded surfaces, etc.), also by nonlinear electronic circuit parts and components, such as diodes, transistors, which are parts of all integrated circuits, receiver front-ends, and other circuit parts that may resonate with either or both the main and difference frequencies that are projected. For example, when the collimated and coherent outputs of two distinct millimeter wave sources are 100 GHz and 101 GHz, the electromagnetic field at the intersection 24 will include a 1 GHz component. Physically, the interference pattern created in the volume of the intersection of collimated parallel polarized beams is a fringe field where the fringe planes are parallel to one another. The fringe planes are traveling in a direction perpendicular to the planes at the rate of the interference difference frequency, i.e. difference between the frequencies. The fringe planes are separated by the fringe period, $\Delta f$, which is determined by $$\lambda_f = \frac{\lambda_o}{2\sin\frac{\theta}{2}} \tag{1}$$

where $\lambda_0$ is the average wavelength of the two collimated beams, and $\theta$ is the angle of intersection between the two collimated beams. As can be seen, the fringe period depends upon the angle of intersection of the intersecting beams. Additionally, when the beams are at substantially equivalent field strengths, full amplitude modulation of the interference field will be achieved.

FIG. 2 illustrates an alternate method to converge electromagnetic beams at a distance in a special case of the converging angle $\theta=0$. Two electromagnetic radiation sources 30, 40 radiate collimated beams 32, 42 of electromagnetic radiation at two separate frequencies, $f_1$ and $f_2$, and in the direction of a polarization beam combiner. The polarization beam combiner combines orthogonally polarized beams by reflecting one beam and permitting transmission therethrough of the other beam. The resultant output is therefore the combined beams of both collimated beams 32, 42 having an interference difference frequency as described above. Again, for example, if $f_1$=100 GHz and $f_2$=101 GHz, the resultant interference difference frequency $\Delta f$=1 GHz. In contrast to the above description, however, the intersection angle, $\theta$ between the two beams is reduced to zero. As such, the fringe period has become infinite, that is to say that there are now no fringes and no spatial variation of intensity in any plane perpendicular to the direction of beam propagation.

In a typical arrangement, the polarization beam combiner 34 is oriented at 45 degrees with respect to the beams (32, 42 in FIG. 2). The polarization beam combiner 34 is rotated to transmit the linearly polarized incident beam 42 with the minimum of loss. The other beam (32 in FIG. 2) will be polarized orthogonal to the first beam to obtain maximum reflection and minimum transmission loss through the polarizer. Once these two beams are combined, they are superimposed and may be directed. That is to say that both beams 32, 42 are transmitted within one effective beam rather than separate converging beams (as described in FIG. 1), and the resultant interference zone 44 is the volume occupied by the merged beams, from the polarizer and beyond.

While a linear polarization beam combiner 34 has been discussed above other embodiments of beam combiners, known to those of ordinary skill in the art, including beam splitters, circular polarization beam combiners, and the like may be substituted accordingly. Additional information relating to superimposition of electromagnetic beams is further described in the background, above, and in co-pending U.S. patent application Ser. No. 10/444,510 incorporated herein by reference.

Having developed methods of effectively combining electromagnetic beams at distant locations, it would be desirable to utilize the difference frequency generated in these interactions. In particular, due to efficiencies of better diffraction limited beams at higher, optical frequencies, it would be useful to down-convert higher frequencies for re-radiation of the lower frequencies.

As used herein, several terms should first be defined. By definition, microwaves are the radiation that lie in the centimeter wavelength range of the EM spectrum (in other words: $1<\lambda<100$ cm, that is, the frequency of radiation in the range between 300 MHz and 30 GHz, also known as microwave frequencies). Electromagnetic radiation having a wavelength longer then 1 meter (or frequencies lower then 300 MHz) will be called "Radio Waves" or just "Radio Frequency" (RF). For simplicity in this disclosure, the RF spectrum is considered to cover all frequencies between DC (0 Hz) and 300 MHz. Millimeter Waves (MMW) are the radiation that lie in the range of frequencies from 30 GHz to 300 GHz, where the radiation's wavelength is less than 10 millimeters. Finally, electromagnetic frequencies from 300 GHz to 30 THz are described as submillimeter waves, or terahertz frequencies. Anything above 30 THz are considered as optical frequencies (or wavelengths), which includes infrared (IR) and visible wavelengths. The optical range is divided into bands such as infrared, visible, ultraviolet. For purposes of this disclosure, millimeter and submillimter frequencies are described throughout, however, these same principles apply to submillimeter and smaller (higher frequency wavelengths), therefore submillimeter, as used herein, can include optical frequencies. As known to those of ordinary skill in the art, for practical purposes the "borders" for these above these frequency ranges are often not precisely observed. For example, a cell phone antenna and its circuitry, operating in the 2.5+ GHz range is associated with RF terminology and considered as part of RF engineering. A waveguide component for example, covering the Ka band at a frequency around 35 GHz is usually called a microwave (and not a MMW) component, etc. Accordingly, these terms are used for purposes of consistently describing the invention, but it will be understood to one of ordinary skill in the art that alternative nomenclatures may be used in more or less consistent manners.

SUMMARY OF THE INVENTION

According to one embodiment of the invention, a high-frequency two-dimensional antenna comprises a plurality of dual-frequency antennas configured to receive signals having first and second frequencies above the microwave band of the electromagnetic spectrum. The dual-frequency antennas are arrayed to an effective length to re-radiate signals at a third frequency, which is down-converted from the first and second frequencies. The signals having first and second frequencies may intersect at an angle. The two-dimensional antenna may therefore be capable of being rotated relative to a bisector of the angle of intersection to thereby steer a direction of re-radiation of signals having the third frequency. Also, adjacent dual-frequency antennas of the two-dimensional antenna may be spaced apart by a distance selected based upon a fringe period in an interference zone of the signals having the first and second frequencies. In such instances, the two-dimensional dual-frequency antenna may be configured such that the distance between adjacent dual-frequency antennas and/or the fringe period are capable of being increased or decreased to thereby steer a direction of re-radiation of signals having the third frequency.

Each dual-frequency antenna can include a plurality of dipole antennas and a plurality of nonlinear resonant circuits. The nonlinear resonant circuits interconnect the dipole antennas and are configured to permit re-radiation of signals having the third frequency over the effective length. According to one aspect of the invention, the plurality of dipole antennas comprise half-wavelength dipole antennas. According to another aspect of the invention, the plurality of dipole antennas may comprise electric dipoles.

The nonlinear resonant circuit that interconnects the plurality of dipole antennas typically includes at least one reactive circuit element and a nonlinear element. The reactive circuit elements are resonant at the down-converted third frequency. The reactive elements typically comprise combinations of capacitive and inductive circuit elements. The nonlinear resonant circuit also typically comprises nonlinear circuit elements, such as a diode. The nonlinear element permits the down conversion of the first and second frequencies to their difference frequency, otherwise known as a beat frequency.

According to another embodiment of the invention, a method of down-converting at least first and second electromagnetic radiation frequencies is provided, where the frequencies are above the microwave band of the electromagnetic spectrum. The method includes transmitting a first electromagnetic beam at a first frequency and transmitting a second electromagnetic beam at a second frequency offset from the first frequency by a difference frequency. The first and second electromagnetic beams are received by a two-dimensional dual-frequency antenna including a plurality of dual-frequency antennas, each dual-frequency antenna including at least two dipole antennas. The first and second frequencies are converted to the difference frequency through a nonlinear resonant circuit coupling the at least two dipole antennas. The coupling of the dipole antenna permits transmitting electromagnetic beams at the difference frequency.

One aspect of the method includes transmitting the first and second electromagnetic beams in intersecting directions. As such, the reception of the first and second electromagnetic beams is performed in the intersection area, otherwise known as the interference zone. Alternatively, the first and second electromagnetic beams may be combined and transmitted in the same direction. For example, they may be combined through a polarization beam combiner.

BRIEF DESCRIPTION OF THE DRAWINGS

Figure 1:
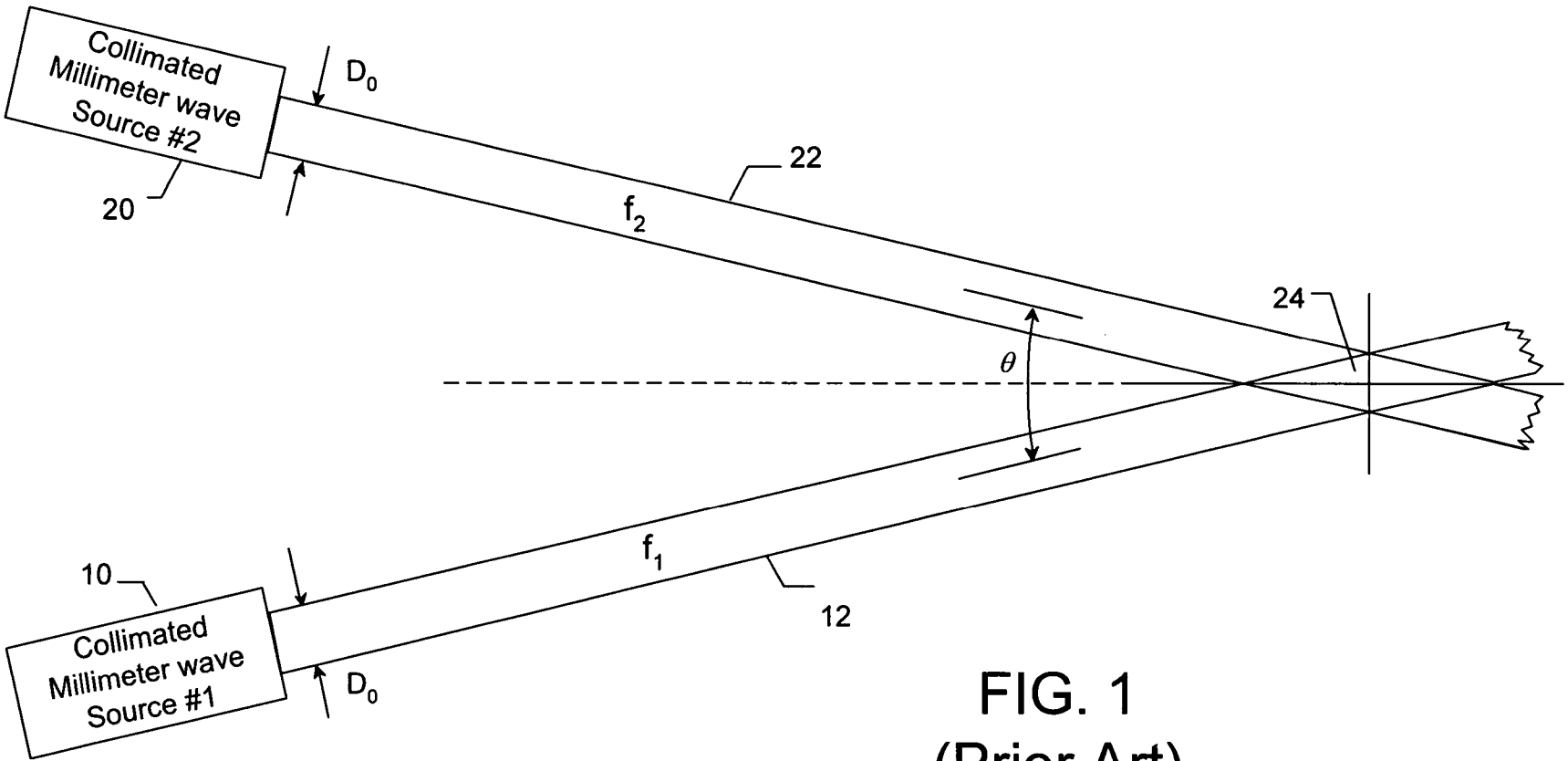
FIG. 1 (Prior Art)
Figure 2:
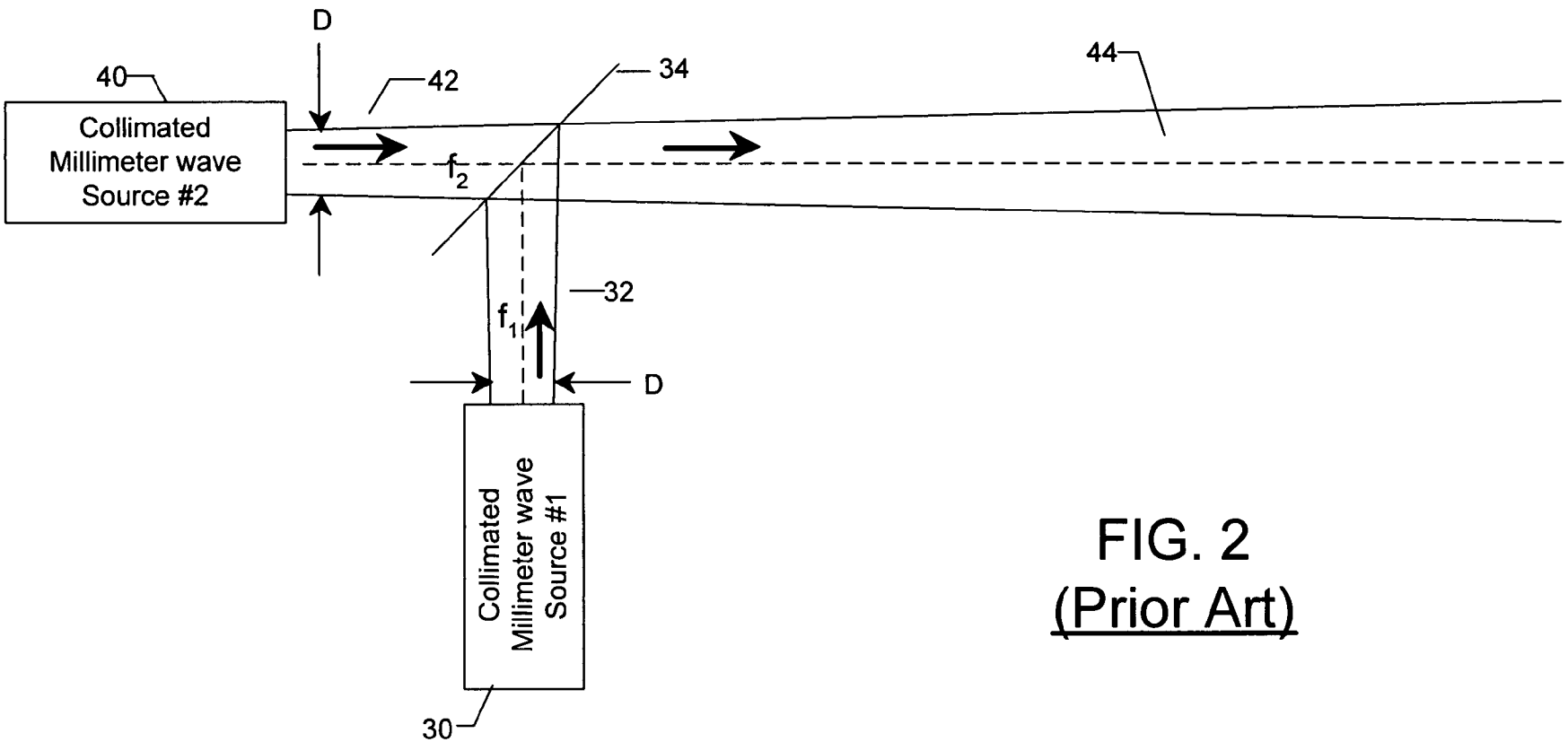
FIG. 2 (Prior Art)
Figure 3:
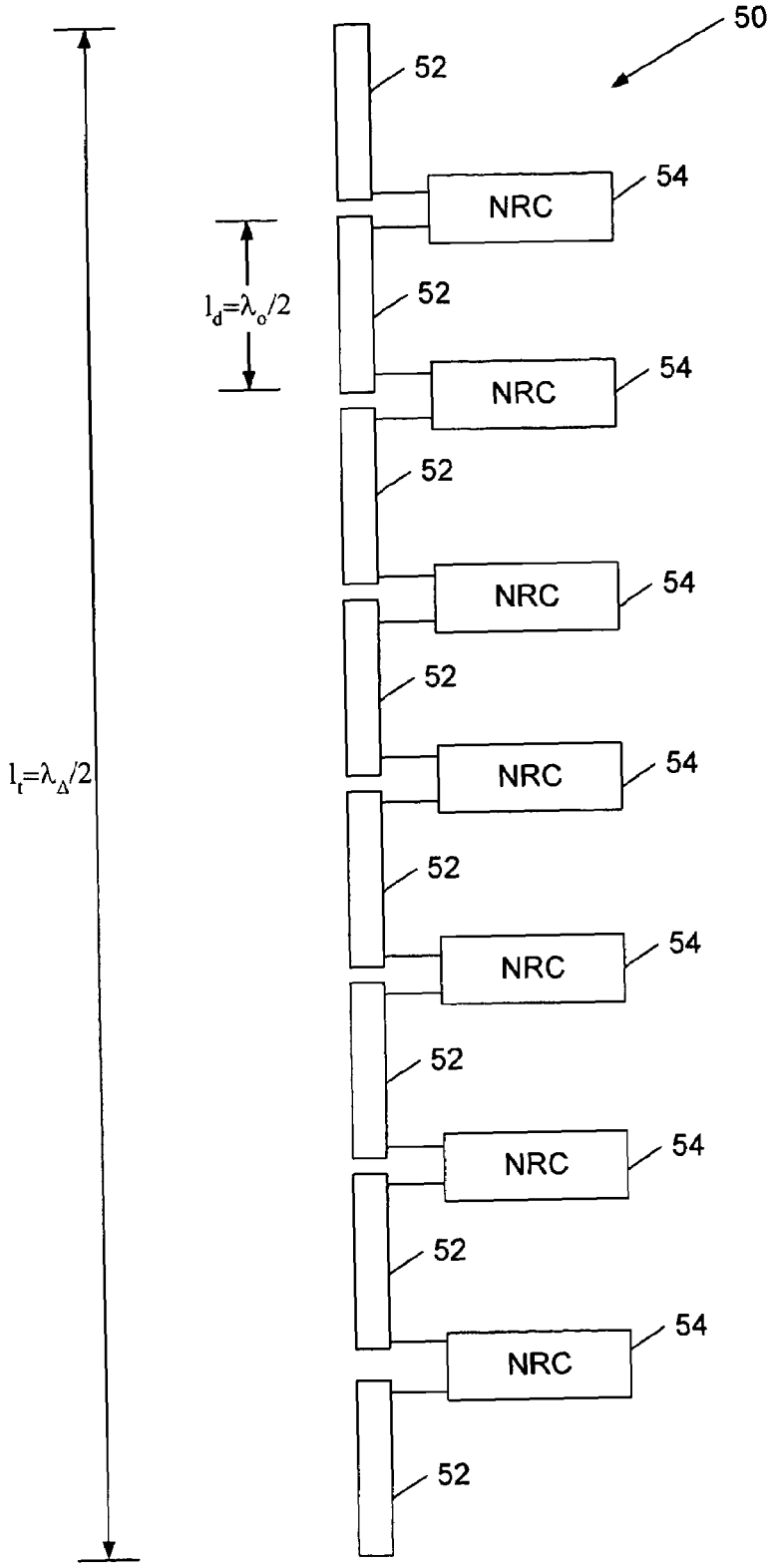
Figure 4B:
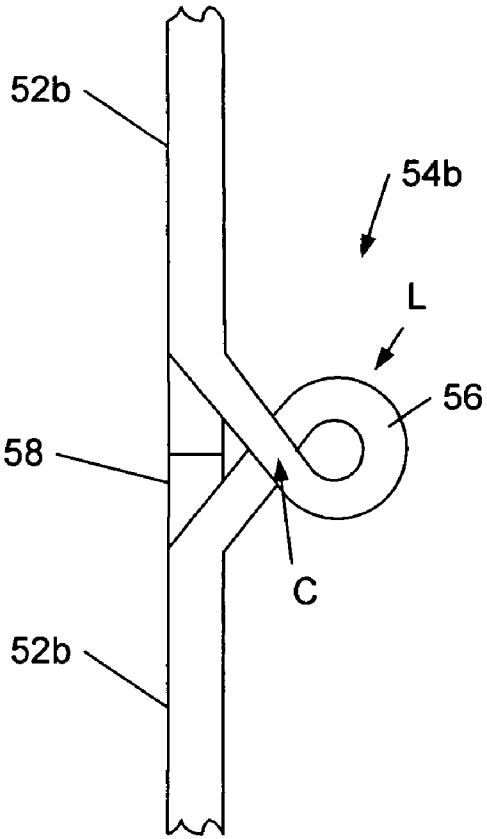
Figure 4A:
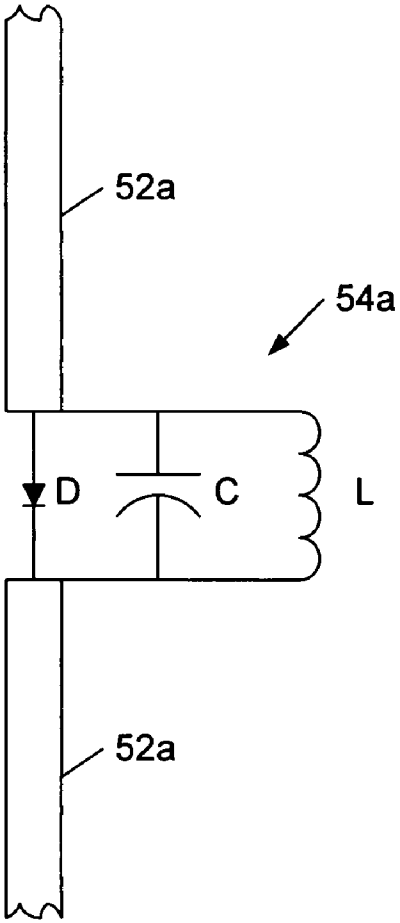
Figure 5:
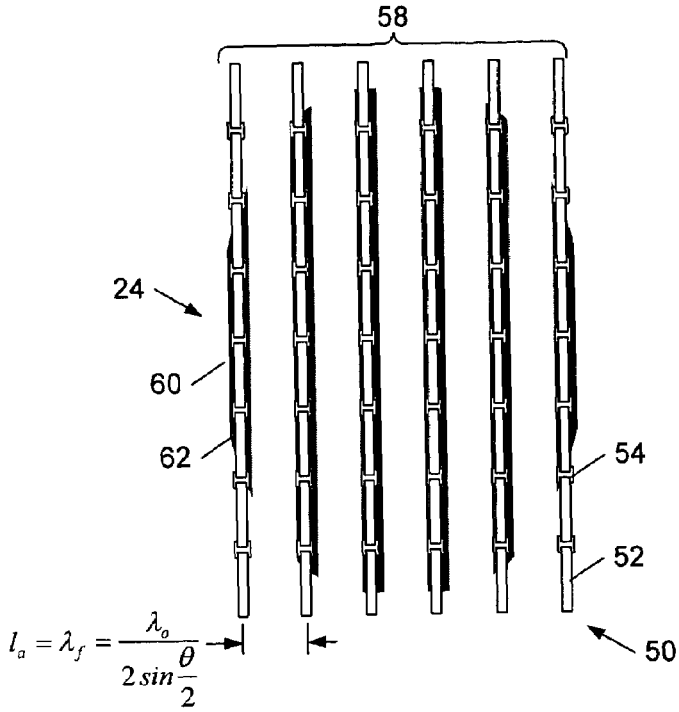
Figure 6:
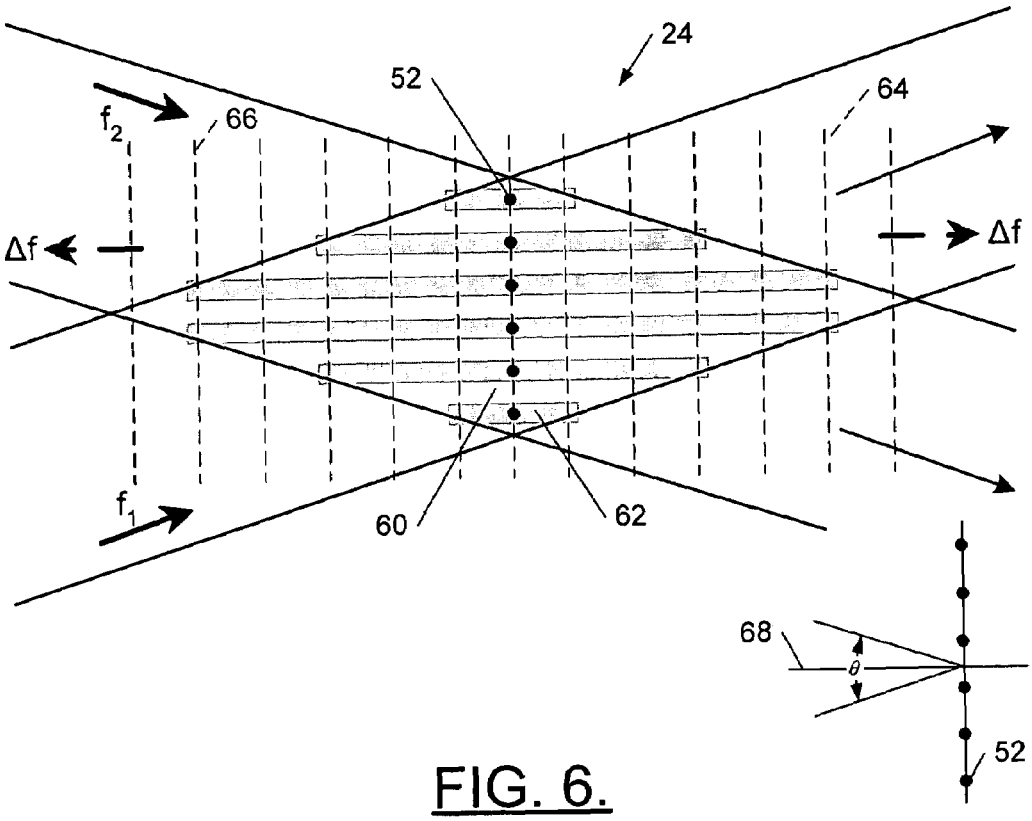
Figure 7A:
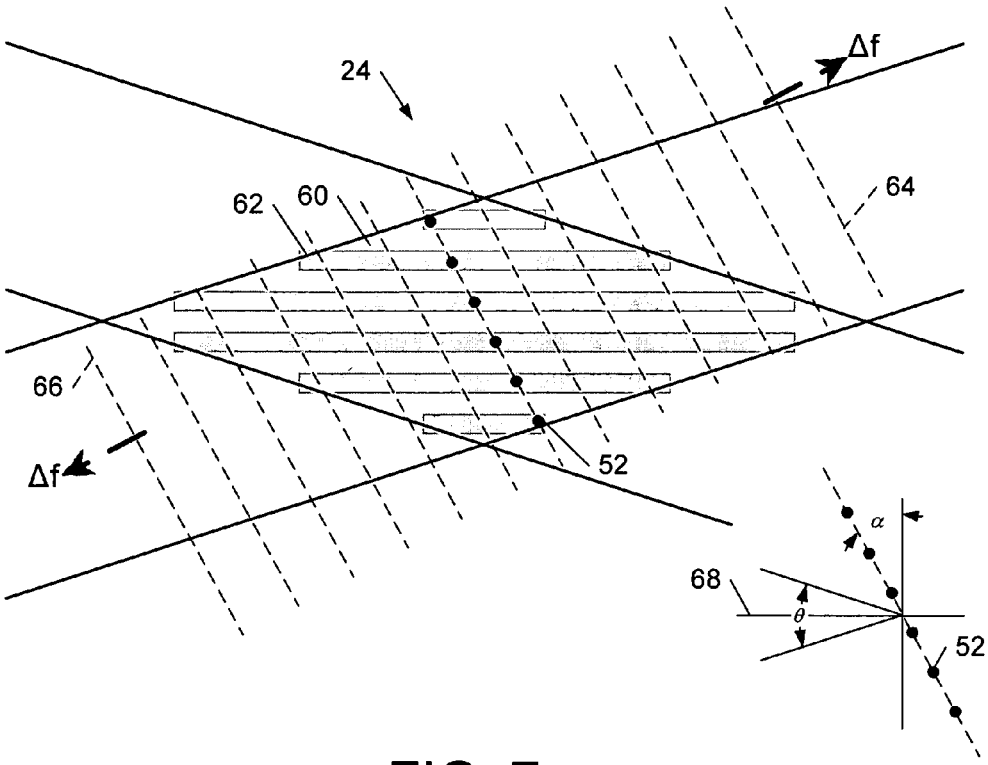
Figure 7B:
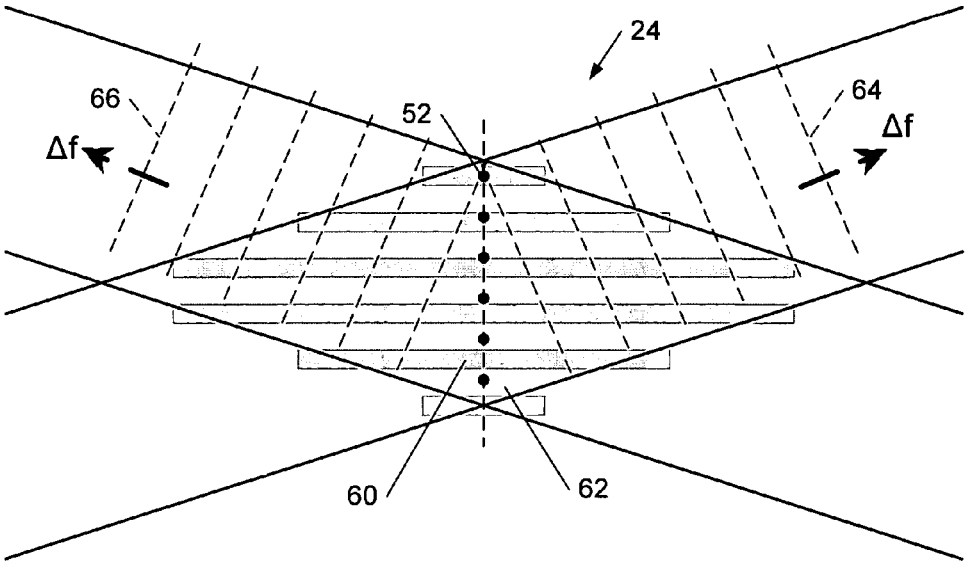

Having thus described the invention in general terms, reference will now be made to the accompanying drawings, which are not necessarily drawn to scale, and wherein:

FIG. 1 is a prior art schematic representing the effects of combining two coherent collimated electromagnetic beams with two different frequencies;

FIG. 2 is a prior art schematic representing the effects of combining two coherent collimated electromagnetic waves with a polarization beam combiner;

FIG. 3 is a plan view of a plurality of dipole antennas interconnected by nonlinear resonant circuits according to one embodiment of the present invention;

FIGS. 4(*a*) and (*b*) are schematic diagrams showing details of a simple nonlinear resonant circuit connecting to the tips of two consecutive dipole antennas according to one embodiment of the present invention;

FIG. 5 is a schematic front view of a high-frequency two-dimensional antenna immersed in the interference zone of two interfering electromagnetic beams according to one embodiment of the present invention;

FIG. 6 is a schematic top view of a high-frequency two-dimensional antenna immersed in the interference zone of two interfering electromagnetic beams according to one embodiment of the present invention; and FIGS. 7(*a*) and (*b*) are schematic top views of a high-frequency two-dimensional antenna of one embodiment of the present invention that is arranged to steer a quasi-plane wave launched during operation of the antenna.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Electromagnetic radiation in the RF (radio frequency), microwave, millimeter and optical wave ranges interacts with thin conducting bodies, such as wires when the conductor is aligned with the electric field of radiation. The interaction is dependent upon conductor length, l, in relation to the radiation wavelength, $\lambda$. A half wavelength dipole antenna, for example, will resonate and reradiate for a conductor length that is one half the radiation wavelength. For any such antenna, the antenna converts the electromagnetic wave to an induced voltage and current. As described above, converged or intersecting beams of electromagnetic radiation at two different frequencies, $f_1$ and $f_2$, exhibit a difference frequency, $\Delta f$, component that can be physically reproduced by intermodulation through nonlinear circuit elements. The intermodulation function of the diode converts the two frequencies to their beat frequencies, one of which is the difference frequency. A conductor and nonlinear circuit elements placed in this intersection of beams can be employed to reradiate the difference frequency. If resonant elements are incorporated in a nonlinear circuit, the circuit can be tuned to selectively resonate the difference frequency.

Referring to FIG. 3 and one embodiment of the invention, a dual frequency nonlinear antenna 50 can reradiate electromagnetic radiation to the difference frequency by employing a nonlinear resonant circuit (NRC) 54 interconnecting multiple antennas 52. The nonlinear resonant circuit 54 is frequency selective, mixing frequencies to the desired resonant frequencies between each antenna 52. In this embodiment, a dual frequency nonlinear antenna 50 comprises a plurality of dipole antennas 52 interconnected by nonlinear resonant circuits 54 that couple frequencies of the antennas. The dual frequency nonlinear antenna 50 can convert the interfering pattern of two beams with frequencies, $f_1$ and $f_2$. The electrical length, $l_d$, of each dipole antenna 52 is approximately half the wavelength of each electromagnetic wave beam, $\lambda_0/2$ (the interfering two beams are near enough in wavelength that the antenna adequately receives both frequencies). The total electrical length, $l_t$, of the dual frequency nonlinear antenna 50 is one half the wavelength of the difference frequency, $\lambda_\Delta/2$.

To down-convert the first and second frequencies, the dual frequency nonlinear antenna 50 is aligned with the direction of the electric field of the first frequency beam and a second frequency beam (see FIGS. 1 and 2), which are separated by a difference frequency. Frequencies of each of the first and second beams are relatively close to one another such that the resonance of each individual half wavelength dipole antenna 52 is an effective receiving antenna at both frequencies. The nonlinear resonant circuit 54 is tuned to be resonant at a frequency, halfway between the frequencies of the two beams so as to permit the interconnection of the individual dipole antennas at the difference frequency but appear as an open circuit at the first and second frequencies. A nonlinear element, such as a diode (not shown), facilitates generation of the difference frequency. Therefore, by providing the identical frequency selective circuits between the adjacent dipoles, it will make the multiple antennas radiate together at the difference frequency, while allowing the individual dipoles between the resonant circuits to resonate at the two individual beam frequencies.

In this regard, the first and second frequencies are effectively down-converted to the difference frequency for reradiation by the total effective length of the dual frequency antenna 50. The total effective length of the antennas, therefore, also is approximately half the wavelength of the difference frequency if the dual frequency antenna structure is in vacuum (or air), and effectively a half dipole antenna at the difference frequency such that the antenna reradiates the difference frequency if the dual frequency dipole structure is in a dielectric medium, or mounted on a dielectric plate (such as glass, sapphire, silicone) the mechanical length of the structure must be shortened in order to maintain the electrical length at $\lambda_\Delta/2$. The reradiated frequency may be employed in a number of ways, such as employing coupling mechanisms, directors, or reflectors.

An example more fully illustrates this embodiment in FIG. 3. A 10 GHz incident electromagnetic radiation interference pattern may be produced by two collimated electromagnetic beams, one beam having a frequency of $f_1$=95 GHz ($\lambda_0 \approx 3$ mm), and the other beam having a frequency of $f_2$=105 GHz ($\lambda_0 \approx 3$ mm). The resultant interference difference frequency is then 10 GHz ($\lambda_\Delta \approx 3$ cm). In this embodiment, eight dipole antennas 52 are chosen, each dipole antenna is approximately one half of the millimeter wave electromagnetic radiation wavelength that is an electrical length of $l_d$=1.5 mm. Each dipole antenna 52 is disposed in the same direction as the other dipole antennas having a spacing of about 430 microns such that the total effective electrical length, $l_t$, of all dipole antennas is 15 mm, which is approximately half of the difference frequency wavelength. It will be noted that other numbers of dipole antennas could be used and spaced to obtain a total effective length of approximately one half the interference frequency wavelength. For example, nine dipole antennas could be employed instead of 8, and a resultant spacing of 200 microns therebetween would also yield a total effective length of 15 mm. It will be noted by those of ordinary skill that mechanical and electrical lengths almost the same, but depend upon the dielectric properties of surrounding materials. When a dipole is mounted on a dielectric plate (hemispace with a dielectric constant $\epsilon$), the mechanical length of a dipole must be shortened to maintain the resonance condition, i.e. to maintain that the electrical length stays $\lambda/2$.

As a number of other examples illustrate, this embodiment in FIG. 3 can advantageously operate with electromagnetic wave beams having frequencies above the microwave band of the EM spectrum, such as beams having frequencies in the infrared and optical bands. As will be appreciated by one of ordinary skill in the art, a typical carbon dioxide ($CO_2$) laser (and most other lasers) can be configured to operate at a number of different wavelengths, including wavelengths in the infrared and optical bands of the EM spectrum. There are more than a dozen individual $CO_2$ laser transitions in the 9.16 to 10.91 micrometer range, each of which (or any combination of these lines simultaneously) can be made to lase when the optical conditions are adjusted to provide for such operation. Two adjacent lines (and some of the strongest), are at 10.59 and 10.61 micrometers.

As a second example, then, a 54 GHz incident electromagnetic radiation interference pattern may be produced by two collimated electromagnetic beams. One beam producing the interference pattern has a frequency of $f_1$=28.27521206 THz ($\lambda_1$=10.61 $\mu$m), and the other beam has a frequency of $f_2$=28.83286119 THz ($\lambda_2$=10.59 $\mu$m) for an average wavelength $\lambda_0 \approx 10.6$ $\mu$m. As shown, the beams producing the interference pattern, as well as the resultant interference difference frequency of 54 GHz ($\lambda_\Delta \approx 5.56$ mm), are in the infrared band of the EM spectrum. In this embodiment, each dipole antenna 52 is approximately one half of the infrared wave electromagnetic radiation wavelength $l_d$=5.3 $\mu$m (i.e., $\lambda_0/2$), and the total effective length of each dual-frequency nonlinear antenna 50 is one half the wavelength of the difference frequency $l_t$=2.781 nm (i.e., $\lambda_{66}/2$). To provide a sufficient number of dipole antennas to cover the entire effective length, then, the dual-frequency nonlinear antenna of this example includes 525 dipole antennas (i.e., ≈2,781/5.3).

In a third example, a 5.362 THz incident electromagnetic radiation interference pattern may be produced by an electromagnetic beam having a frequency of $f_1$=27.49770852 THz ($\lambda_1$=10.91 μm), and another beam having a frequency of $f_2$=32.7510917 THz ($\lambda_2$=9.16 μm) for an average wavelength $\lambda_0$≈10.035 μm. As in the second example, the beams producing the interference pattern, as well as the resultant interference difference frequency of 5.362 THz ($\lambda_{66}$≈5.56 mm), are in the infrared band of the EM spectrum. Each dipole antenna 52 has a length $l_d$=5.0 μm (i.e., $\lambda_0/2$) which, as before, is approximately one half of the optical wave electromagnetic radiation wavelength. Also, the total effective length of each dual-frequency nonlinear antenna 50 $l_t$=28 μm (i.e., $\lambda_\Delta/2$), which is one half the wavelength of the difference frequency. In this example, to provide a sufficient number of dipole antennas to cover the entire effective length, the dual-frequency nonlinear antenna includes 5 dipole antennas (i.e., ≈28/5.0).

In yet another, fourth example, a 31.667 THz incident electromagnetic radiation interference pattern may be produced by two collimated electromagnetic beams, one having a frequency of $f_1$=583.090379 THz ($\lambda_1$=514.5 nm), and the other having a frequency of $f_2$=614.7540984 THz ($\lambda_2$=488 nm) for an average wavelength $\lambda_0$≈501.25 nm. In this example, the beams producing the interference pattern are in the optical band of the EM spectrum, while the resultant interference difference frequency of 31.667 THz ($\lambda_{66}$≈9.7 μm) is in the infrared band of the EM spectrum. Each dipole antenna 52 is approximately one half of the infrared wave electromagnetic radiation wavelength $l_d$=0.5 μm (i.e., $\lambda_0/2$), and the total effective length of each dual-frequency nonlinear antenna 50 is one half the wavelength of the difference frequency $l_t$=5.0 μm (i.e., $\lambda_\Delta/2$). To provide a sufficient number of dipole antennas to cover the entire effective length, then, the dual-frequency nonlinear antenna of this embodiment includes 10 dipole antennas (i.e., 5.0/0.5).

Referring to FIG. 4(*a*), as each dipole antenna 52*a* is joined by a nonlinear resonant circuit 54*a* comprised of reactive elements, in this embodiment an inductor, L, and a capacitor, C, and a nonlinear element, in this embodiment a diode, D. The reactive components are configured to provide an effective open circuit to beam frequencies, $f_1$ and $f_2$, and a quasi short circuit at the lower difference frequency, Δf. The diode is the nonlinear circuit element that promotes the intermodulation of the two frequencies to their beat frequencies. It will be understood by those of ordinary skill in the art that other resonant circuits or filtering circuits or alternative nonlinear circuit elements may be employed in various forms other than these listed, and are well known in the field of electromagnetic signal processing.

In one embodiment illustrated in plan view of FIG. 4(*b*), a nonlinear resonant circuit 54*b* may comprise a conductive planar loop 56 and p-n junction 58 or a Schottky diode deposited on a substrate with a layer of insulation, such as a substrate of silicon with an oxide layer on top ($SiO_2$) by using lithographic manufacturing techniques. In order to obtain the resonant qualities of an antenna as described in the example above, the capacitance and inductance would be quite small. Depending upon the resonance frequency desired, a small one turn conductive planar loop 56 (or just a fraction of a loop) is all that is needed in order to facilitate fabrication of a high frequency, resonant circuit using standard monolithic deposition techniques. As an example at extremely high frequencies, a capacitive values of one femtoFarad is typical to obtain resonance at 30 THz frequency (wavelength is 10 micron). Conductive material, such as aluminum or other conductive materials, is looped to form an inductive element, L, while opposite ends of the loop are overlaid with an insulator therebetween, such as aluminum oxide, to form a parallel plate capacitive element C. In this regard, the inductive and capacitive properties are controlled by the dimensions of the loop and the oxide layer thickness in order to obtain the appropriate values of inductance and capacitance. The diode 58 may be formed in a number of different ways, such as creating a metal-oxide-metal (MOM) sandwich, which forms a tunneling junction diode (such as Nickel-NiO-Nickel) if the oxide layer thickness is kept 50A or less (and that thickness is carefully controlled). Schottky planar diodes or the Schottky "cat-whisker" type diodes for very high THz frequencies is an example of other types of diodes like linearly adjacent regions formed of p and n material in accordance with monolithic manufacturing techniques. Likewise, the dipole antennas 52*b* may also be disposed and comprised of materials such as aluminum, gold, silver, cooper, nickel etc. to facilitate deposition in combination with the planar conductive loop 56.

The foregoing is illustrative of one embodiment of a dual frequency dipole antenna 50 comprising half-wavelength electric dipole antennas 52 effectively arrayed to achieve a dual frequency half-wavelength electric dipole antenna. It will be understood by one of ordinary skill in the art that a dual-frequency antenna may comprise other forms of dipole antenna. For example, a magnetic dipole antenna (conductive loop) exhibits fields corresponding to those of an electric dipole antenna with reversed electric and magnetic fields. Therefore the properties and effects of a series of a plurality of magnetic dipole antenna interconnected by nonlinear resonant couplers in a manner similar to the above would be apparent to one of ordinary skill.

As will also be apparent to one of ordinary skill in the art, when the first and second electromagnetic beams are combined with a polarization combiner prior to down-converting there are no fringes or spatial variation of intensity in the plane perpendicular to the direction of beam propagation. Combined beams permit arranging the dual-frequency antennas to re-radiate in phase when separated by a distance equivalent to the fringe field peaks. In phase re-radiation of the down-converted frequency, therefore, produces a phased array of antennas. By arranging the array in rows of 2N+1 dual-frequency antennas, the lobes of the antennas effectively cancel and promote a diffraction limited radiation pattern from the array.

Referring now to FIG. 5, the dual-frequency antenna 50 may be provided in an arrayed plurality of dual-frequency antennas forming a two-dimensional dual-frequency antenna 58. As shown, each dual frequency dipole antenna of the two-dimensional antenna may be separated from adjacent dual-frequency antennas by a distance, $l_a$, based upon the distance between fringe peaks (i.e., fringe period, $\lambda_f$). As discussed above, the fringe fields, comprising areas of constructive interference 60 and areas of destructive interference 62, are separated by a distance that can be determined using equation (1) and are normal to the difference frequency traveling wave. To re-radiate the difference frequency at maximum amplitudes when the plane of the two-dimensional antenna is perpendicular to the bisector (shown as line 68 in FIG. 6) of the angle of intersection between the two beams, θ, the dual-frequency antennas may be arranged in rows separated by the distance between fringe peaks, i.e., a distance $l_a=\lambda_f$.

As shown in a front view in FIG. 5 and a top view in FIG. 6, then, the two-dimensional dual-frequency antenna 58 can be immersed in the interference zone 24 of two interfering electromagnetic beams, as such is shown in FIG. 1. In operation, the summary effects of currents induced in the dual frequency nonlinear antennas 50 of the two-dimensional antenna can launch a quasi-plane wave at the difference frequency, Δf, where the quasi-plane wave propagates in a direction perpendicular to the plane of the two-dimensional antenna. More particularly, the quasi-plane wave propagates in a forward direction away from the wave sources (shown by dashed lines 64), and a backward direction toward the wave sources (shown by dashed lines 66).

As an example, consider a two-dimensional dual-frequency antenna 58 immersed in the interference zone 24 of two electromagnetic beams, as such is shown in FIG. 1, where the beams have an average frequency $f_0$=100 GHz ($\lambda_0$=3 cm). Also, consider that the two collimated millimeter wave sources 10, 20 are separated by a distance of 12 meters and are configured to intersect at a distance of 1 km. In such an instance, the converging angle θ=0.6875 degrees (i.e., $2\times\tan^{-1}(6/1000)$). From equation (1), it can be shown that the fringe period $\lambda_f$=0.25 meters. In turn, then, the two-dimensional dual-frequency antenna may be arranged in rows such that each dual frequency dipole antenna is separated from adjacent dual frequency dipole antennas by the distance $l_a$=0.25 meters.

Further, assuming diffraction-limited beam qualities and propagation, and further considering the beams having a 1 meter diameter $D_0$ at their respective sources 10, 20, it can be shown that the two beams will interfere in an interference zone 24 having a diameter of approximately 4 meters. In this regard, due to divergence of the beams from the respective sources, the diameter of interference of the beams is given by $$D(z) = 2r\sqrt{1+\left(\frac{\lambda z}{\pi r^2}\right)^2} \tag{2}$$

In equation (2), D(z) is the beam diameter at a distance z (e.g., 1 km), r is the initial radius of the beam (e.g., $D_0/2$), and λ is the wavelength of the beam (e.g., 3 cm). Because the distance between dual frequency dipole antennas 50 of the two-dimensional antenna 58 $l_a$=0.25 meters, the two-dimensional antenna can include sixteen dual frequency dipole antennas to cover the entire 4 meter interference zone.

If the difference frequency, Δf (or the difference wavelength–Δλ), is chosen such that the fringe spacing and/or the separation between dual frequency dipole antennas 50 is an odd integer multiple of Δλ/2 (i.e., $l_a=\lambda_f=(2N+1)\times\Delta\lambda/2$), propagation of the Δf field in the plane of the array will be minimized (typically reduced to zero). On the other hand, when the fringe period, and thus the dual frequency dipole antenna spacing, is made equal to an integer multiple of Δλ (i.e., $l_a=\lambda_f=N\times\Delta\lambda$), an enhanced field strength exists at the difference frequency propagating outward from the interference zone in the plane of the array.

As shown in FIG. 6, all of the dual frequency dipole antennas 50 of the two-dimensional antenna 58 are illuminated in the same phase with respect to the interference zone 24 of two electromagnetic beams. In addition, as shown in the inset of FIG. 6, the plane of the two-dimensional antenna is perpendicular to the bisector 68 of the angle of intersection between the two beams, θ. In operation, then, the two-dimensional antenna can launch a quasi-plane wave at the difference frequency, Δf, where the quasi-plane wave propagates in a direction perpendicular to the plane of the two-dimensional antenna and parallel to the bisector of the angle of intersection between the two beams. As will be apparent to one of ordinary skill in the art, the two-dimensional antenna can be arranged, however, to steer the quasi-plane wave at the difference frequency in other directions relative to the plane of the two-dimensional antenna and/or the bisector.

For example, as shown in FIG. 7(*a*), when the two-dimensional antenna 58 is rotated by an angle, α, relative to the plane 70 perpendicular to the bisector 68 of θ, the two-dimensional antenna can launch the quasi-plane wave to propagate in a direction perpendicular to the plane of the two-dimensional antenna, but at an angle offset from parallel to the bisector. In this manner, the two-dimensional antenna can rotate to thereby steer the quasi-plane wave. It should be understood, however, that by rotating the two-dimensional antenna, to re-radiate the difference frequency at maximum amplitudes, the dual-frequency antennas 50 may be arranged in rows separated by a distance greater than the distance between fringe peaks. More particularly, the distance $l_a$ between adjacent dual-frequency antennas may be given by $$l_a = \frac{\lambda_f}{\cos\alpha} = \frac{\lambda_o}{2\sin\frac{\theta}{2}\times\cos\alpha} \tag{3}$$

By increasing the distance, all of the dual frequency dipole antennas 50 of the two-dimensional antenna remain illuminated in the same phase with respect to the interference zone 24 of the beams.

Additionally or alternatively, for example, as shown in FIG. 7(*b*), the fringe period $\lambda_f$ and/or the distance $l_a$ between adjacent dual-frequency antennas 50 of the two-dimensional antenna 58 can be increased or decreased (FIG. 7(*b*) illustrating an increase in the fringe period). More particularly, the distance $l_a$ and/or the fringe period $\lambda_f$ can be increased or decreased such that the absolute difference between the distance $l_a$ and the fringe period $\lambda_f$ (i.e., $|l_a-\lambda_f|$) exceeds zero, as when $l_a=\lambda_f$. By increasing or decreasing the fringe period or the distance between adjacent dual-frequency antennas, all of the dual frequency dipole antennas 50 of the two-dimensional antenna are not illuminated in the same phase with respect to the interference zone 24 of the beams. And by illuminating one or more of the dual frequency dipole antennas in a different phase than one or more of the other dual frequency dipole antennas, the two-dimensional antenna can launch the quasi-plane wave to propagate in a direction offset from the plane of the two-dimensional antenna, with the two-dimensional antenna positioned parallel to the bisector of the angle of intersection, θ, between the two beams.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A high-frequency two-dimensional antenna, comprising:

a plurality of dual-frequency antennas configured to receive signals having first and second frequencies above the microwave band of the electromagnetic spectrum, and being arrayed to an effective length to re-radiate signals at a third frequency, the third frequency being the difference between the first and second frequencies.

2. The high-frequency two-dimensional antenna according to claim 1, wherein each dual-frequency antenna comprises:

a plurality of dipole antennas; and a plurality of nonlinear resonant circuits, each nonlinear resonant circuit interconnecting at least two of the plurality of dipole antennas and configured to permit re-radiation of signals having the third frequency over the effective length.

3. The high-frequency two-dimensional antenna according to claim 2, wherein each of the plurality of dipole antennas comprises a half-wavelength dipole.

4. The high-frequency two-dimensional antenna according to claim 2, wherein each of the plurality of dipole antennas comprises an electric dipole.

5. The high-frequency two-dimensional antenna according to claim 2, wherein the nonlinear resonant circuit comprises at least one reactive circuit element.

6. The high-frequency two-dimensional antenna according to claim 5, wherein the at least one reactive circuit element comprises an inductive circuit element interconnecting at least two of the plurality of dipole antennas.

7. The high-frequency two-dimensional antenna according to claim 6, wherein the inductive circuit element comprises a looped conductor.

8. The high-frequency two-dimensional antenna according to claim 5, wherein the at least one reactive circuit element comprises a capacitive circuit element interconnecting at least two of the plurality of dipole antennas.

9. The high-frequency two-dimensional antenna according to claim 8, wherein the capacitive circuit element comprises a parallel plate capacitor.

10. The high-frequency two-dimensional antenna according to claim 2, wherein the nonlinear resonant circuit comprises at least one nonlinear circuit element interconnecting at least two of the plurality of dipole antennas.

11. The high-frequency two-dimensional antenna according to claim 10, wherein the nonlinear circuit element comprises a diode.

12. The high-frequency two-dimensional antenna according to claim 1, wherein the signals having the first and second frequencies intersect at an angle, and wherein the two-dimensional antenna is configured such that the two-dimensional antenna is capable of being rotated relative to a bisector of the angle of intersection to thereby steer a direction of re-radiation of the signals having the third frequency.

13. The high-frequency two-dimensional antenna according to claim 1, wherein adjacent dual-frequency antennas are spaced apart by a distance selected based upon a fringe period in an interference zone of the signals having the first and second frequencies.

14. The high-frequency two-dimensional antenna according to claim 13, wherein the two-dimensional antenna is configured such that at least one of the distance between adjacent dual-frequency antennas and the fringe period is capable of being one of increased and decreased to thereby steer a direction of re-radiation of the signals having the third frequency.

15. A method of down-converting at least first and second electromagnetic radiation frequencies:

transmitting a first electromagnetic beam at a first frequency above the microwave band of the electromagnetic spectrum;

transmitting a second electromagnetic beam at a second frequency above the microwave band of the electromagnetic spectrum and offset from the first frequency by a difference frequency;

receiving the first and second electromagnetic beams at a high-frequency two-dimensional antenna comprising a plurality of dual-frequency antennas, each dual-frequency antenna including at least two dipole antennas;

converting the first and second frequencies to the difference frequency through a nonlinear resonant circuit coupling the at least two dipole antennas; and transmitting an electromagnetic beam at the difference frequency from the coupled at least two dipole antennas.

16. The method according to claim 15, wherein the step of transmitting a first electromagnetic beam comprises transmitting in a first direction; the step of transmitting a second electromagnetic beam comprises transmitting in a second direction; and the step of receiving is performed in an interference zone of the first and second electromagnetic beams.

17. The method according to claim 15, further comprising combining the first and second electromagnetic beams in a common direction.

18. The method according to claim 15, further comprising combining first and second electromagnetic beams through a polarization beam combiner.

19. The method according to claim 15, wherein the steps of transmitting first and second electromagnetic beams comprises transmitting first and second electromagnetic beams having a common polarization.

20. The method according to claim 15, wherein the first and second electromagnetic beams intersect at an angle, and wherein the method further comprises rotating the two-dimensional antenna relative to a bisector of the angle of intersection to thereby steer transmission of the electromagnetic beam at the difference frequency.

21. The method according to claim 15, further comprising spacing adjacent dual-frequency antennas of the two-dimensional antenna apart by a distance selected based upon a fringe period in an interference zone of the first and second electromagnetic beams.

22. The method according to claim 21, further comprising one of increasing and decreasing at least one of the distance between adjacent dual-frequency antennas and the fringe period to thereby steer transmission of the electromagnetic beam at the difference frequency.

* * * * *